US006454231B1

(12) United States Patent
Fischer

(10) Patent No.: US 6,454,231 B1
(45) Date of Patent: Sep. 24, 2002

(54) SPACE SAVING RACK FOR SMALL TOOLS AND MISCELLANEOUS ITEMS

(76) Inventor: Bernard Fischer, 2122 Stebbins Ct., Orlando, FL (US) 32808-5440

( * ) Notice: Subject to any disclaimer, the term of this patent is extended or adjusted under 35 U.S.C. 154(b) by 15 days.

(21) Appl. No.: 09/920,461

(22) Filed: Aug. 1, 2001

(51) Int. Cl.[7] ..... A47B 96/06

(52) U.S. Cl. ..... 248/220.41; 248/220.31; 211/70; 211/70.6

(58) Field of Search ..... 211/60.1, 70, 70.6, 211/95; 248/220.41, 220.31, 110, 111, 314

(56) References Cited

U.S. PATENT DOCUMENTS 2,033,430 A * 3/1936 Kirik ..... 211/95
2,639,820 A * 5/1953 Lee ..... 211/70
D215,012 S * 8/1969 Marselli ..... D6/569
3,472,389 A * 10/1969 Lowe ..... 211/70
3,985,324 A * 10/1976 Larson ..... 248/223
D334,481 S * 4/1993 Ramotar ..... D6/322
5,326,068 A * 7/1994 Spears ..... 248/682
6,273,277 B1 * 8/2001 Geldenhuys ..... 211/70

* cited by examiner

*Primary Examiner*—Leslie A. Braun
*Assistant Examiner*—Gwendolyn Baxter

(57) ABSTRACT

A space saving rack primarily designed for use on vertical pegboard but not limited thereto, comprising an L-shaped hook or mounting assembly, said assembly configured to fit within two adjacent holes in pegboard having a plurality of holes, and a supporting member free to rotate in a horizontal plane; rotating said supporting member brings the desired tool or item to the front for easy removal or placement.

1 Claim, 6 Drawing Sheets

SPACE SAVING RACK FOR SMALL TOOLS AND MISCELLANEOUS ITEMS

BACKGROUND

1. Field of Invention

The present invention relates to a tool holder and more particularly to a space saving rotatable holder for small tools and miscellaneous items when said tools and items are not in use.

In many instances, after they are used, small tools and items are merely placed in a drawer or bin together with other tools and items or in a haphazard fashion on hooks on a wall or pegboard and it is sometimes difficult to find a particular tool or item when it is desired to use it: at other times the tools or items are misplaced in some forgotten place so that they are difficult to find.

2. Description of Prior Art

Several types of tool holders have been proposed—for example, in U.S. Pat. Nos. 2,872,145 (1959) to Goldsholl; U.S. Pat. No. 3,737,131 (1973) to Larson; U.S. Pat. No. 4,461,443 (1984) to Dauman; and U.S. Pat. No. 5,641,079 (1973) to Schmidt to name a few.

Use of these holders requires a clear vertical space equal to the length of the tool being held. Horizontal racks limit the number of tools that can be stored because the rack itself takes up so much space.

Use of hooks for storing small tools is a waste of space since it would take so many hooks to hold the tools.

SUMMARY

In accordance with the present invention a rack comprises a holder free to rotate in a horizontal plane on a vertical rod mounted on pegboard.

OBJECTS

The present invention is a space saving rack to hold small tools and miscellaneous items in a neat and orderly fashion.

The rack provides a means to store small items in their original containers, made containers, and "as-is".

This rack provides more storage in a limited horizontal and vertical space than present tool holders.

The rack provides an easy means for storing tools and small items so that they can be brought to the front for easy removal or replacement.

The rack provides a means for storing tools in such manner that handles are exposed and easily grasped.

DRAWINGS

A preferred embodiment of the invention chosen for purposes of illustration and description is shown in the accompanying drawings, forming part of the specification, wherein:

FIGS. 2A to 11A are plan views of some of the possible configurations of the article holder.

FIGS. 2B to 11B are side views of said article holder with articles in place.

DESCRIPTION

Figure 1:
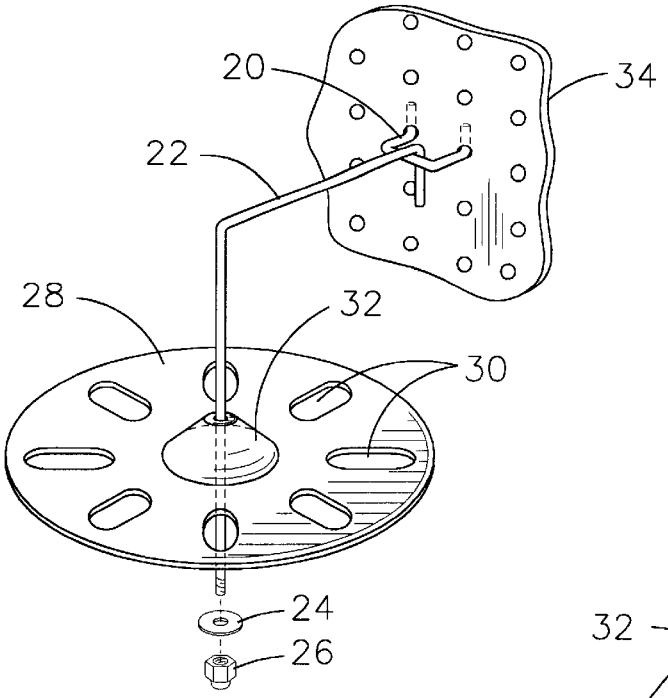
FIG. 1 is a perspective view of an article holder made in accordance with the present invention.
Figure 2A:
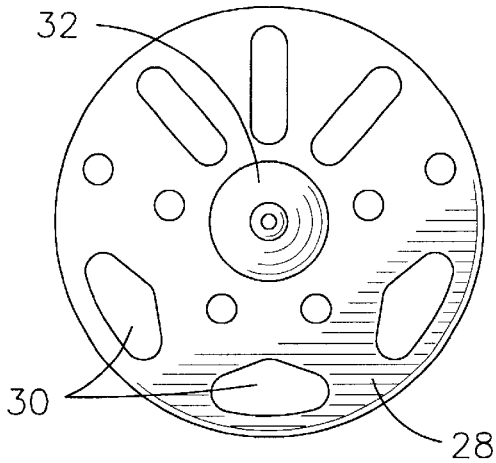
Figure 2B:
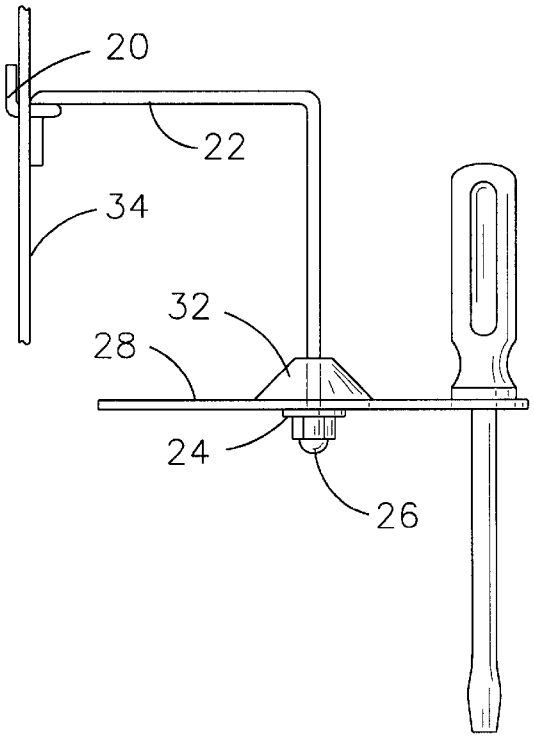
Figure 3A:
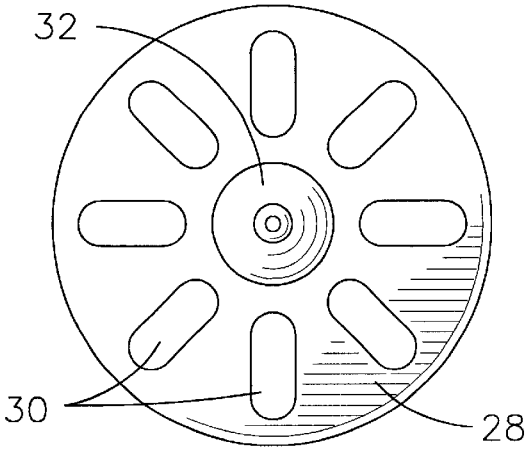
Figure 3B:
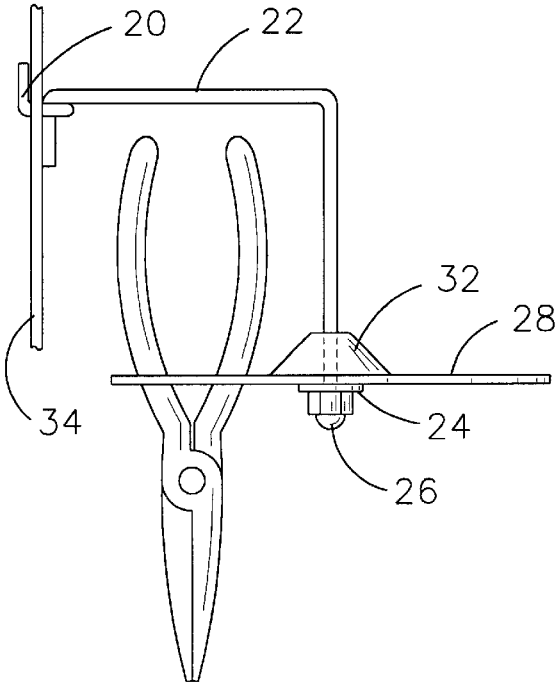
Figure 4A:
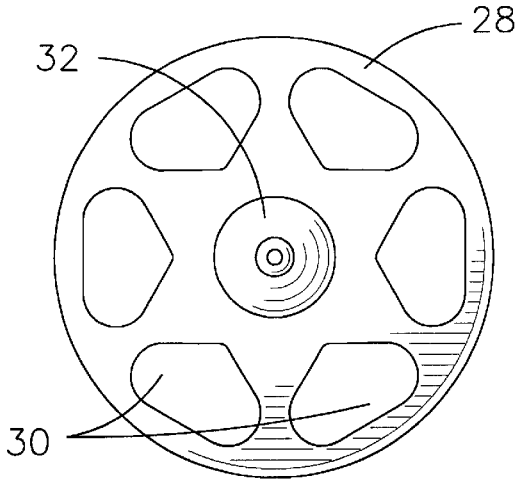
Figure 4B:
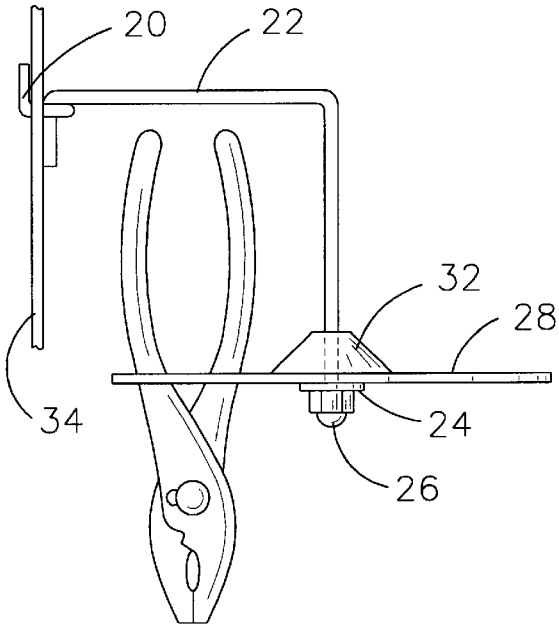
Figure 5A:
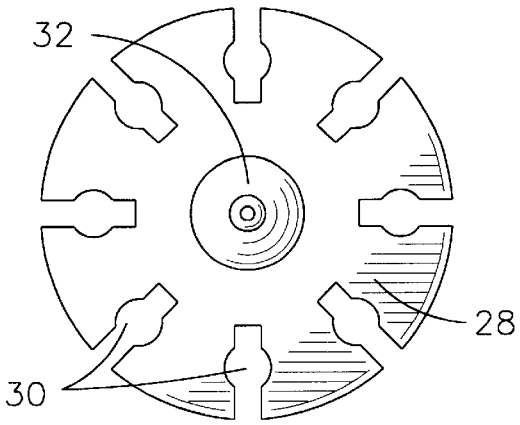
Figure 5B:
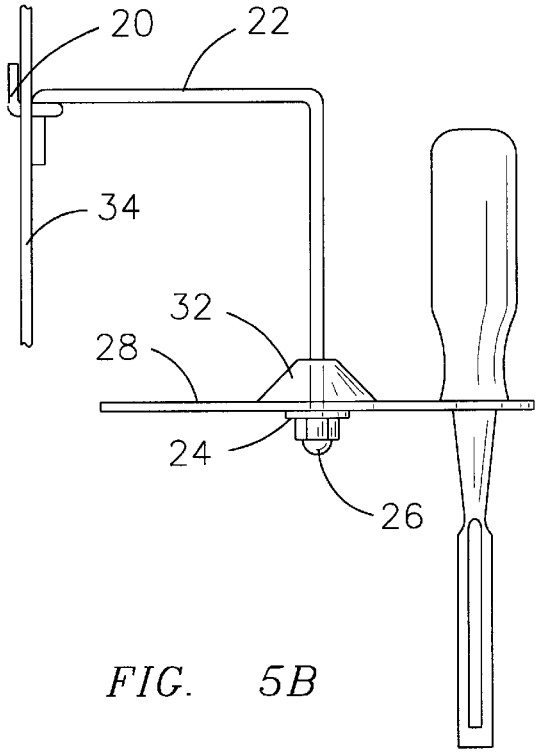
Figure 6A:
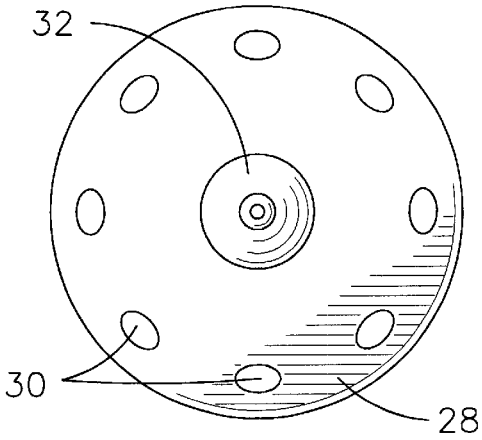
Figure 6B:
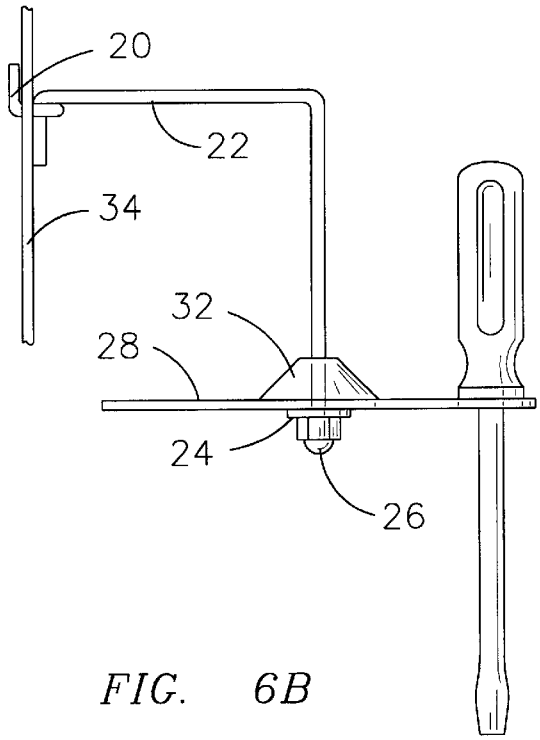
Figure 7A:
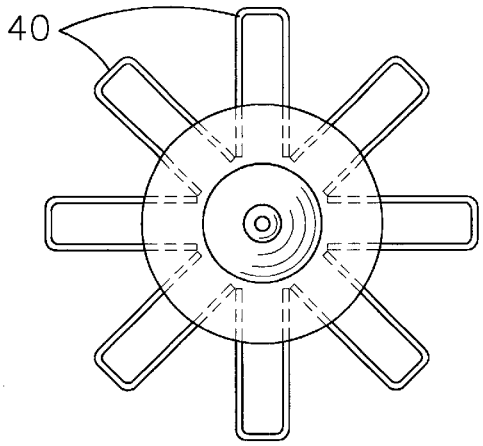
Figure 7B:
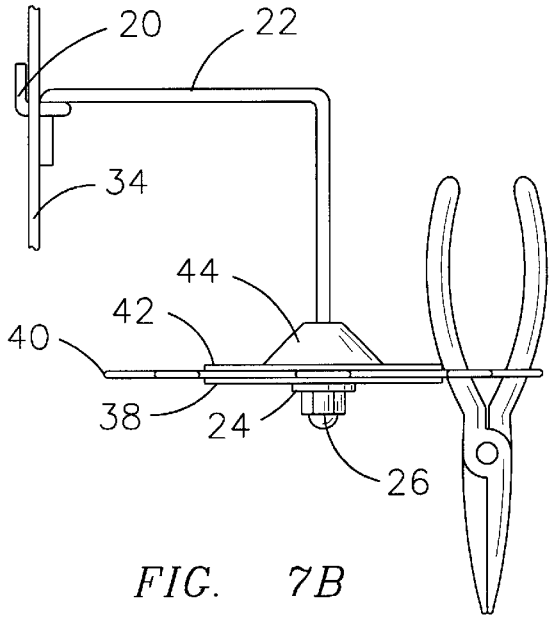
Figure 8A:
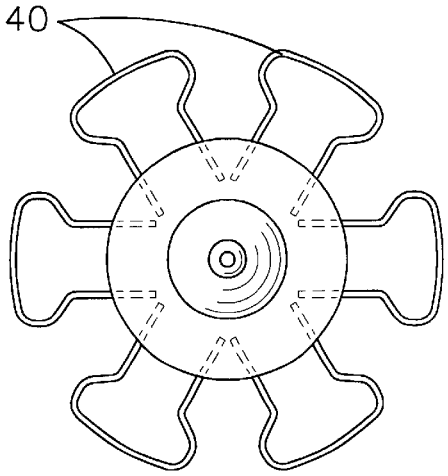
Figure 8B:
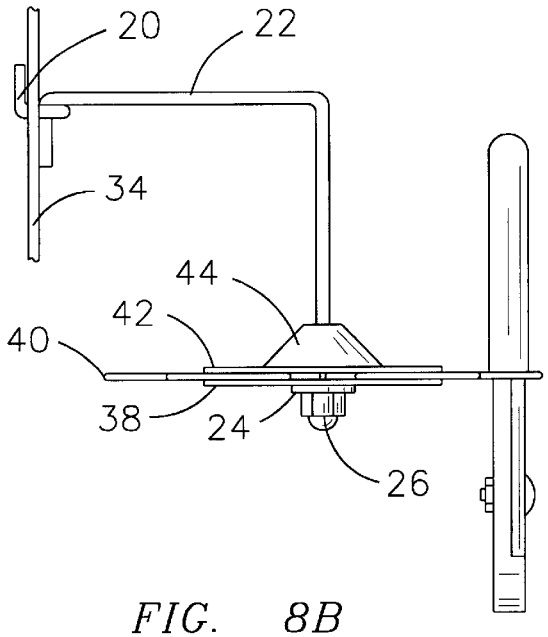
Figure 9A:
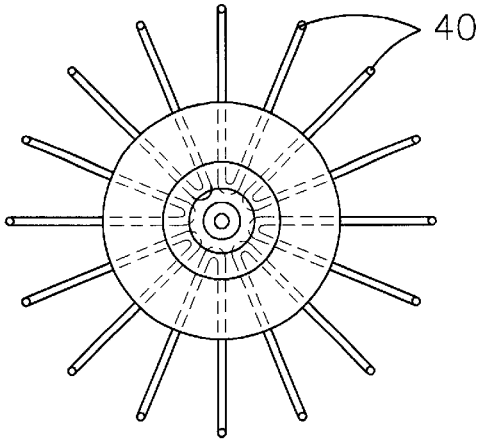
Figure 9B:
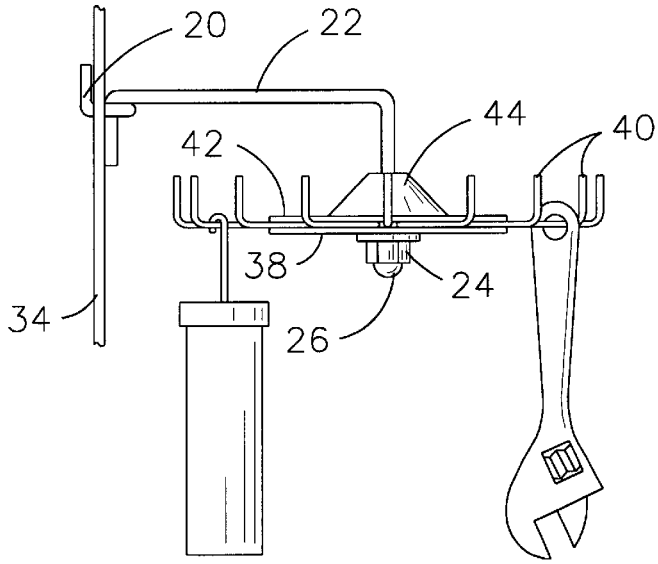
Figure 10A:
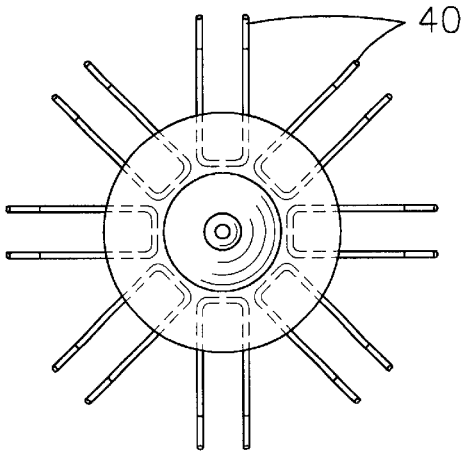
Figure 10B:
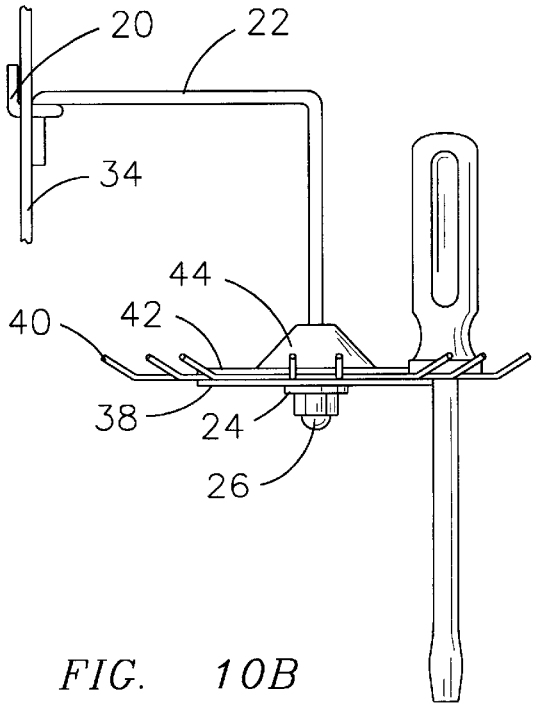
Figure 11A:
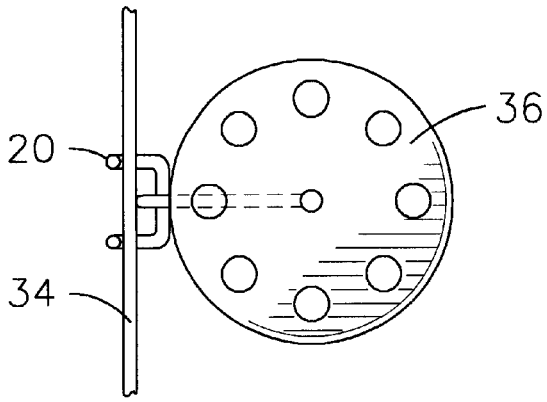
Figure 11B:
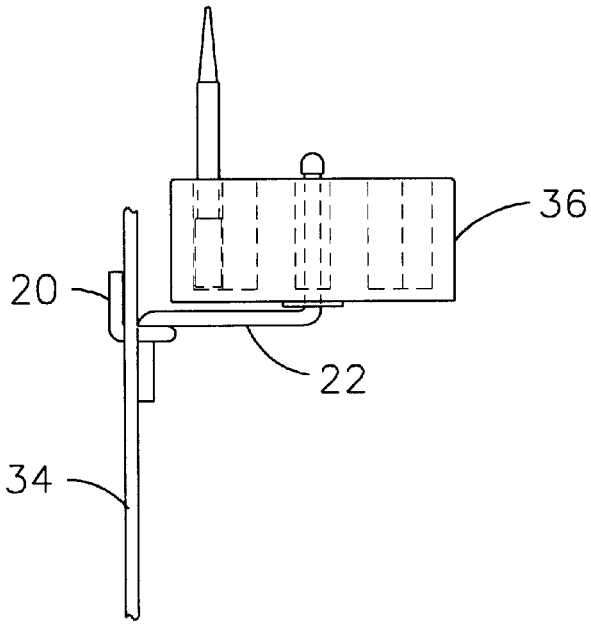

Referring to the drawings and more particularly to FIG. 1, the present invention comprises an inverted L-shaped pegboard hook, an article holder, and miscellaneous hardware. The pegboard hook is comprised of two parts: U-shaped part 20 with the ends turned up and configured to fit into two adjacent horizontal holes of pegboard 34, rod 22 having a short bent down portion to brace against the pegboard 34, a horizontal portion to extend the article holder 28 away from the pegboard and a vertical portion to support the article holder 28 held in place by washer 24 and nut 26, said rod 22 being welded to aforesaid U-shaped part 20. The article support 28 in FIG. 1 is a flat disc with a series of apertures 30 and raised center portion 32 to provide stability. FIGS. 2A to 6A are top views of additional configurations of article discs; FIGS. 2B to 6B are side views of said discs with articles thereon. FIGS. 7A to 10A are wheel related holders comprising the aforementioned L-shaped rod 22 and associated elements, bottom plate 38, spokes 40, and top plate 42 with raised portion 44 to provide stability. FIGS. 7B to 10B are side views of said wheel related holders with articles shown thereon. FIG. 11A is top view of article support 36 with rod 22 bent vertically upward, FIG. 11B is side view of FIG. 11A with an article shown thereon.

While there have been described what are at present considered to be the preferred embodiment of the invention, it will be understood that various modifications may be made therein, and it is intended to the appended claims all such modifications as fall within the scope of the invention.

What is claimed is:

1. A tool holder rack for supporting a plurality of small tools and miscellaneous items from a pegboard, said tool rack holder having a first U-shaped member having upwardly turned ends and adapted to be configured to fit into two adjacent horizontal holes of the pegboard; a second U-shaped member having a downwardly extending short leg and a downwardly extending long leg, said downwardly extending short leg being welded to the bottom portion of the first U-shaped member with said short leg adapted to be braced against said pegboard, the end of the downwardly extending long leg being threaded, said first and second U-shaped members being formed of a wire material; a substantially flat disc shaped article holder having a central opening and a raised conical center portion for stability when mounted on said downwardly extending long leg, said article holder having a top plate, a bottom plate and spokes between said top and bottom plates, each said spokes having openings for supporting small tools and miscellaneous items, said article holder being secured to said downwardly extending long leg by said central opening and a washer and nut being mounted on the threaded portion of the downwardly extending long leg securing said article holder to said downwardly extending long leg.

* * * * *